United States Patent [19]

Quick et al.

[11] Patent Number: 4,589,789

[45] Date of Patent: May 20, 1986

[54] RIBBON STORAGE AND TRANSPORT MECHANISM

[75] Inventors: Harry C. Quick, Waynesboro; John M. Read, Charlottesville, both of Va.

[73] Assignee: Genicom Corp., Waynesboro, Va.

[21] Appl. No.: 535,618

[22] Filed: Sep. 26, 1983

[51] Int. Cl.[4] ..... B41J 32/02

[52] U.S. Cl. ..... 400/195; 400/196.1; 400/224

[58] Field of Search ..... 400/196.1, 208, 213, 400/224, 228, 124, 195, 248; 101/93.04

[56] References Cited

U.S. PATENT DOCUMENTS

| | | | |
|---|---|---|---|
| 3,643,777 | 2/1972 | Anderson et al. | 400/196.1 X |
| 3,782,278 | 1/1974 | Barnett et al. | 400/124 X |
| 4,110,050 | 8/1978 | Wood et al. | 400/213 X |
| 4,209,261 | 6/1980 | Bell et al. | 400/224 X |
| 4,383,774 | 5/1983 | Yonkers | 400/196.1 X |
| 4,484,825 | 11/1984 | Wilczewski et al. | 400/196.1 X |
| 4,493,572 | 1/1985 | Van Ocker et al. | 400/196.1 |

FOREIGN PATENT DOCUMENTS

| | | | |
|---|---|---|---|
| 2816714 | 10/1978 | Fed. Rep. of Germany | 400/196.1 |
| 3023907 | 3/1982 | Fed. Rep. of Germany | 400/196.1 |
| 130385 | 10/1981 | Japan | 400/196.1 |

*Primary Examiner*—Edgar S. Burr
*Assistant Examiner*—Moshe I. Cohen
*Attorney, Agent, or Firm*—Cushman, Darby & Cushman

[57] ABSTRACT

Inked ribbon storage and transport mechanism for electronic printers for economical ribbon positioning and inversion.

5 Claims, 3 Drawing Figures

RIBBON STORAGE AND TRANSPORT MECHANISM

BACKGROUND OF THE INVENTION

This invention related to inked ribbon cartridges and more particularly to a cartridge for mounting in a printer or similar machine for storing a substantial length of ribbon and delivering it in a continuous or intermittent motion for printing purposes across a long print column.

In the past, it has been common to store ribbon in a stuffing box or cartridge in folded form. Since the cartridge provides a housing from which ribbon by an endless loop can be supplied and returned, one needed only install the cartridge into an appropriate support on the printer to be ready for operation, thus substantially minimizing ribbon handling. Examples of such prior art ribbon handling arrangements are disclosed in U.S. Pat. Nos. 3,726,381; 3,621,968; 3,643,777; 2,685,357 and 3,989,132.

Problems, however, have been encountered with respect to such endless type ribbon arrangements, particularly where vast quantities of the ribbon are required to be stored and then exposed to a large print column of the order of 132 columns and wherein printing takes place at an extremely high rate. One approach to solving the ribbon problem, of course, is to make the cartridge wider and store a larger volume of ribbon. Ultimately, this becomes unfeasible because of lack of space requirements and the sheer difficulty of handling such a bulky ribbon. Another approach has been to make use of the entire ribbon surface of a wider ribbon. By tilting the cartridge properly, the moving ribbon can be made to move diagonally with respect to the print line such that the entire surface of the ribbon is available for printing. The use of a wider ribbon and the requirement for canting the ribbon relative to the print line, however, resulted in having the print head elevated in order that the upper edge of the canted ribbon could be reached. In application, the added elevation introduces disadvantages. These disadvantages became more acute at the higher speeds and the longer ribbon spans. Elevating the print head resulted in a more costly and more space-consuming design. Also, a special supporting structure had to be devised. This added structure and the increased elevation introduced vibration and other instability problems. Where a shuttle printer is involved, as for example shown in U.S. Pat. No. 3,782,278, the added mass and elevation complicates the problem of attaining smooth, low power, high efficiency shuttle action.

SUMMARY OF THE INVENTION

Accordingly, it is an object of this invention to provide an improved ribbon storage and transport mechanism.

It is a further object of this invention to provide an improved ribbon storage and support cartridge for use with shuttle printers.

It is a further object of this invention to provide an improved impact printer arrangement affording advantages in ribbon positioning and ribbon inverting.

It is a further object of this invention to provide improvements in stuffing an endless ribbon into an elongated reservoir and moving it over a long span along a print line for presentation for printing purposes while minimizing the necessity for moving the print head in order to be able to scan essentially the entire ribbon surface.

It is a further object of this invention to provide an improved ribbon cartridge for use with shuttle printers to achieve smooth, low power, high efficiency shuttle action.

DESCRIPTION OF THE PREFERRED EMBODIMENTS

Figure 1:
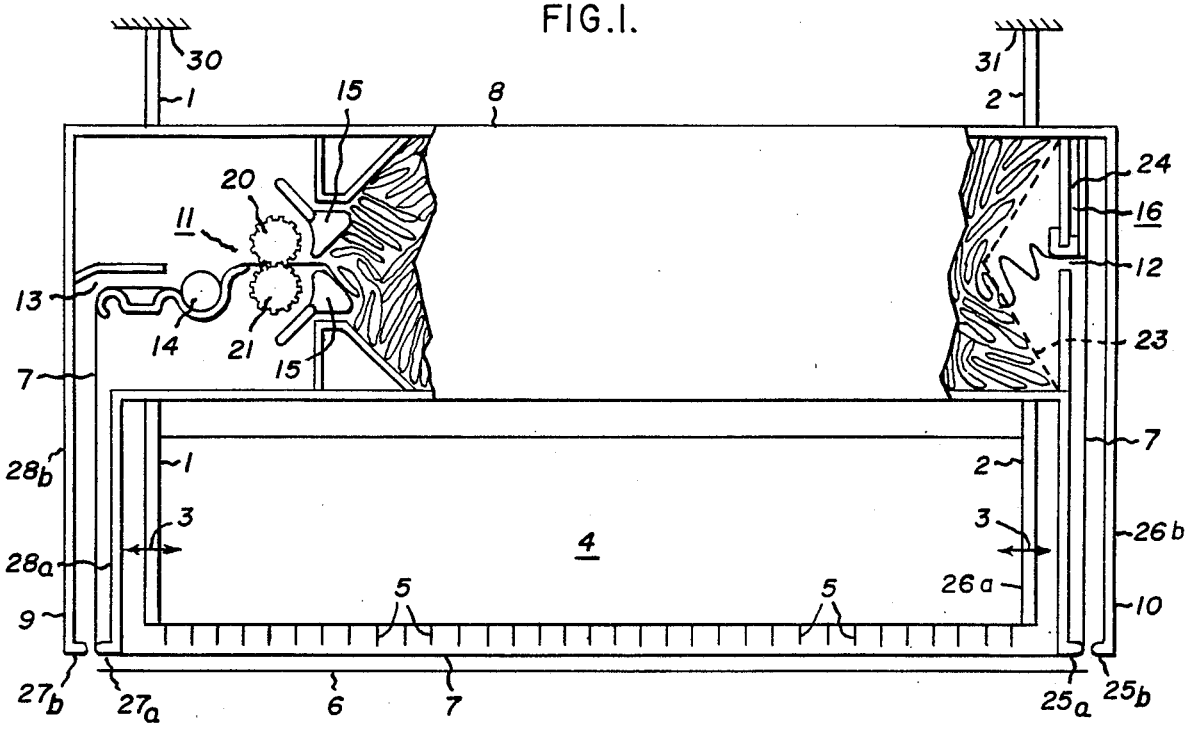
FIG. 1 is a generalized sketch of a shuttling printer mechanism including a ribbon cartridge useful in explaining the principles of the present invention.

Referring now to FIG. 1, a shuttle printer of general purpose design is shown with the present cartridge incorporated. The shuttling mechanism comprises a pair of flexible bands 1 and 2 attached at one end 30 and 31 to a rigid base such as the printer frame and which are driven by a common means not shown to produce reciprocating action shown by arrows 3. Supported between the shuttling ends of the bands is a carrier 4 which carries the printing elements which in a particular embodiment comprise individual styli 5 adapted for movement in the direction to cause impact printing on a paper web such as 6 through a moving ribbon 7. In particular embodiments a quantity of print wires numbering 33 or 66 were spaced along the carrier 4 and adapted to traverse a line of type on the paper web 6 accommodating 132 columns. Thus, depending on the number of wires, each print wire was intended to span a plurality of columns during the shuttling action. At the appropriate time as selected wires are positioned at the desired column locations, print actuators, not shown, cause the selected print wires 5 to be driven forward and impact the paper web 6 through the inked ribbon 7 forming marks at the desired column locations. Printers of this type are designed for extremely fast action and substantially continuous operation. This, of course, places a heavy demand on the inked ribbon mechanism.

Figure 2:
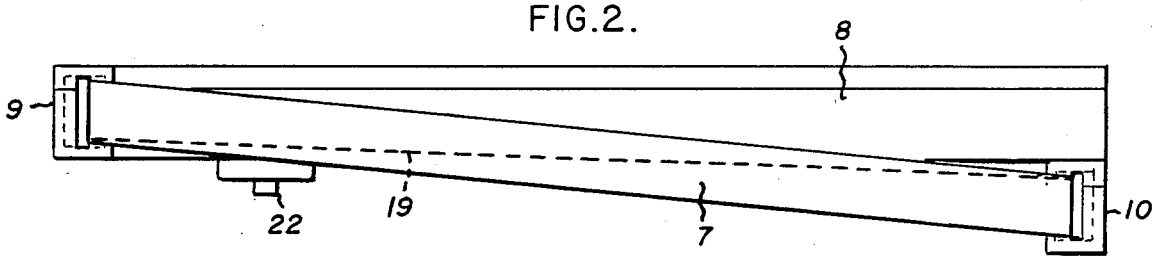
FIG. 2 is a front view of the ribbon cartridge illustrating the cartridge arms responsible for the ribbon slope across a line of print.

FIGS. 1 and 2 illustrate a ribbon cartridge or ribbon stuffing box 8 lying in a first plane, a first arm 9 lying in said first plane in the line of the shuttling action 3 and protruding from the box 8 in the direction of the paper web. A second arm 10 lying in a second plane is displaced vertically from the first plane and in the line of the shuttling action. The significance of the displacement of the two arms in the different planes will be described shortly. The first and second arms protrude from the box 8 in the direction of the paper web. At least one of the arms is located outside the area of shuttling action. Drive means 11, to be described shortly, is provided at one end of the cartridge for moving the ribbon from a remote end of the second arm 10 through the open space between the arms 9 and 10 and diagonally across a line of print 19 shown in FIG. 2 to the first arm 9. A line of print is established across the paper 6 by the shuttling action and actuation of print wires 5. After one line of print has taken place, the paper 6 is indexed vertically to the next line of print. Essentially, the line of print is defined by the line of print wires carried on the carrier 4. Ribbon 7 comprises an extensive length of endless inked ribbon. Mechanism 11, located in a first portion of the cartridge 8, operates to draw the ribbon from arm 10 across the line of print down the arm 9 and then stuff it into a second portion of the box 8 where the ribbon is folded randomly in a compressed manner as shown. Thus mechanism 11, located in the first portion of the box, operates to pull the ribbon through the first arm 9 and stuff it into a second or storage portion of the cartridge 8. A ribbon exit 12 is provided for connecting the second portion of the box to the second arm 10. A ribbon entrance 13 connects the box to the first arm 9. Mechanism 11 comprises two pinch rollers 20 and 21 driven by means of an external shaft 22 shown in FIG. 2. The teeth of rollers 20 and 21 grip the ribbon and pull it from its extended portion across a line of print through the arm 9 through the entrance portion 13 past the guide roller 14 past two stripping mechanisms 15 into the second portion of the box where they are stored until withdrawn before being presented for printing action. The operation of the ribbon drive mechanism employing stripper rollers is well known. Reference can be made to U.S. Pat. No. 4,213,716 dated July 22, 1980 and assigned to the present assignee. Pressure of the compressed ribbon in the first portion of the box causes the ribbon to move towards the exit portion 12. A dam 23 is provided (shown in dotted line form) near the exit portion at the bottom of the cartridge to restrain the ribbon in a compressed portion until sufficient buildup of pressure causes clumps of the ribbon to trip or tumble over into the dam into, in essence, a decompression portion of the box where it can be withdrawn through the exit 12 in the end wall 24 and the arm 10 for presentation to a line of print before the record medium 6.

Figure 3:
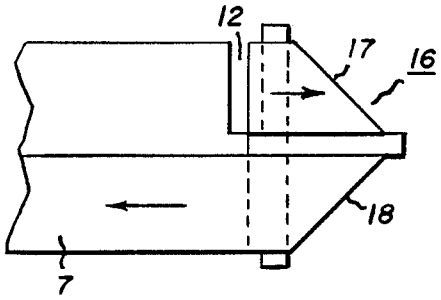
FIG. 3 is a detailed sketch of the converter for moving ribbon from one plane to another and for reversing the ribbon face to be presented for printing.

Referring to FIGS. 3 and 1, in accordance with an embodiment of the invention, a converter 16 is positioned between the exit 12 and the second arm 10 for reversing the ribbon face being presented for printing and for moving the ribbon from the first plane in which the first arm 9 and the ribbon stuffing box are located to the second arm 10 located between guide posts 25*a* and 25*b*. Guide posts 25*a* and 25*b* are formed in end walls 26*a* and 26*b* located in the second plane, and guide posts 27*a* and 27*b* formed in end walls 28*a* and 28*b* are located in the first plane. FIG. 3 illustrates schematically the details of this ribbon reversing guide and plane changing mechanism. Essentially, the mechanism for reversing the ribbon and dropping it to a lower plane comprises a converter 16. The ribbon is shown coming out of the stuffing box as shown by the solid arrow at the top of the drawing. The ribbon folds along the sloped portion 17 at the top of the cartridge and proceeds to the sloped portion 18 near the bottom of the cartridge. The ribbon 7 passes around the bend 18 and emerges at the lower level shown in the diagram moving towards the end of arm 10 for presentation to the line of print. The consequence of moving the ribbon through the converter 16 is to move the ribbon from its upper location in the plane of the stuffing box to its lower location in the plane of the arm 10 while reversing the face of the ribbon so that first one side and then the other side of the ribbon is presented to a line of type.

FIG. 3 illustrates how the converter 16 is positioned at one end of the cartridge to accomplish the dual function described.

Referring to FIG. 2, there is shown in greater detail a front view of a cartridge incorporated in a shuttle printing mechanism.

If the arms 9 and 10 were in the same plane, a problem would arise if one attempted to utilize the entire width of the ribbon along a print line shown as dotted line 19 on ribbon 7 extending between arms 9 and 10. For the ribbon to cross diagonally across a line of print while exposing the full width of the ribbon, prior art arrangements have resorted to tilting the entire cartridge. This has led to a number of problems as previously mentioned including the requirement to have the print head raised so as to allow the ribbon to be scanned from an upper edge to a lower edge of its width. In the present invention the arm 10 is caused to lie in a plane below the plane containing the arm 9 and the stuffing box. By this simple expedient the necessity for modifying the mounting of the shuttle mechanism and all the attendant disadvantages are obviated. In addition, by combining the function of moving the ribbon from one plane to another and reversing the face of the ribbon, a simple, more reliable, lower cost, lower weight overall structure is possible.

It will be appreciated that modifications may be made in the various structures disclosed in order to produce or carry out the present invention. For example, while in FIG. 1 the arms 9 and 10 were shown to be both outside the shuttling action of the carrier 4, it is possible that only the arm 10 needs to be retained outside the area of shuttling action of the bands 1 and 2, since this arm places the ribbon at an elevation with respect to the line of print such that printing, and hence shuttling action, takes place at the upper edge of the ribbon adjacent the end of arm 10. Of course, modifications of some of the specific steps cited describing embodiments of the invention will occur to those skilled in the art. All such modifications which come within the spirit and teaching of the disclosure are intended to be covered by the following claims. For example, the arms and the first and second portions of the cartridge may be reversed with the ribbon moving diagonally upward from left to right.

What we claim as new and desire to secure by Letters Patent of the United States is:

1. In combination, a shuttle printer comprising:

a shuttling dot matrix print mechanism aligned for shuttling action along a line of print, and a ribbon cartridge comprising (a) a ribbon storage box portion lying in a first plane, (b) a first arm lying in said first plane and protruding from said box, (c) a second arm lying in a second plane displaced perpendicularly from said first plane but parallel thereto, (d) said first and second arms protruding from said storage box portion, (e) an endless ribbon, (f) means for moving said ribbon from a remote end of said second arm through open space diagonally across said line of print to said first arm, (g) means located in a first portion of said cartridge for pulling said ribbon from said first arm and stuffing said ribbon in a randomly compressed manner in said storage box portion of said cartridge, (h) a ribbon exit passageway connecting said storage box portion of said cartridge to said second arm, (i) a ribbon entrance passageway connecting said storage box portion of said cartridge to said first arm, (j) a dam structure being located adjacent said exit passageway for restraining ribbon movement before permitting it to reach said ribbon exit passageway, and (k) a converter means positioned between said ribbon exit passageway and said second arm for simultaneously (1) reversing the ribbon face and (2) translating the ribbon from said first plane in said cartridge to said second plane in said second arm whereby said ribbon moves within said arms along mutually parallel paths.

2. An arrangement according to claim 1 further comprising:

means for horizontally mounting said cartridge on said printer such that said first plane is substantially horizontal and parallel to said line of print and the span of ribbon disposed between said first and second arms is asymmetrical to said horizontal print line.

3. An arrangement for moving an impact printing ribbon diagonally across a line of print on a printer, said arrangement comprising:

a ribbon cartridge lying substantially in a first plane, an endless printing ribbon, a first arm lying substantially in said first plane and projecting from said cartridge, a second arm lying in a second plane displaced perpendicularly from said first plane but parallel thereto, said second arm projecting from said cartridge, said projections of said first and second arms being parallel to one another, means for moving said printing ribbon from a remote end of said second arm through open space to said first arm including (a) means located in a first portion of said cartridge for pulling said ribbon from said first arm and stuffing the thus pulled ribbon into a second portion of said cartridge, (b) a ribbon exit connecting said cartridge to said second arm, (c) a ribbon entrance connecting said cartridge to said first arm, (d) a dam located adjacent said exit for restraining ribbon movement before permitting it to reach said cartridge exit, and (e) a ribbon plane and direction changing means positioned between said cartridge exit and said second arm for simultaneously (1) reversing the ribbon face and (2) moving the ribbon from said first plane to the second arm located in said second plane whereby said ribbon travels along respective paths within said arms.

4. A print ribbon storage and transport cartridge for use in passing an exposed portion of an endless print ribbon diagonally across a line of impact printing devices and for storing the portions not so exposed, said cartridge comprising:

an endless print ribbon;

a generally planar storage box having a ribbon entrance port and a ribbon exit port for temporarily storing, in randomly folded compressed condition, ribbon passed thereinto via said entrance port and for controllably passing out stored ribbon via said exit port as it is pulled therefrom;

a ribbon drive means disposed adjacent said entrance port for transporting ribbon thereinto;

first and second parallel extended arms projecting outwardly from opposite ends of said storage box and having parallel ribbon passageways therewithin for passing ribbon from said exit port to said drive means and, in the process, for passing ribbon between the extended distal ends of said arms where the ribbon is accessible to an intended print line which is parallel to said planar storage box;

one of said first and second arms lying in a common plane with said planar storage box and said drive means while the other of said arms lies in a different but parallel second plane such that the ribbon is passed diagonally across said intended print line when it passes between the extended distal ends of said arms; and ribbon plane changing and direction reversing converter means disposed adjacent said other of the arms for simultaneously (1) transporting said ribbon between said first and second planes and (2) reversing the outwardly directed ribbon surface whereby said ribbon travels along parallel paths within said arms.

5. A print ribbon storage and transport cartridge as in claim 4 wherein said ribbon plane changing and converter means comprises:

a first sloped-wall engaged with said ribbon at said first plane level and over which said ribbon travels away from said first plane and towards said second plane; and a second sloped-wall engaged with said ribbon at said second plane level over which ribbon travels after passage over said first sloped-wall.

* * * * *